US006286465B1

(12) United States Patent
Hughes et al.

(10) Patent No.: US 6,286,465 B1
(45) Date of Patent: Sep. 11, 2001

(54) WATER HEATER FLUE SYSTEM

(75) Inventors: Dennis R. Hughes, Hartford; Marc W. Akkala, Cedarburg; Kevin M. Field, Oconomowoc; Robert F. Poehlman, South Milwaukee, all of WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 09/561,126

(22) Filed: Apr. 28, 2000

(51) Int. Cl.[7] ..... F22B 5/02

(52) U.S. Cl. ..... 122/18.31; 122/44.2; 122/155.2; 138/38; 29/890.046

(58) Field of Search ..... 122/13.01, 18.3, 122/18.31, 44.2, 155.2, 48; 138/38, 39; 165/109.1, 183; 29/890.046, 890.03

(56) References Cited

U.S. PATENT DOCUMENTS

| | | | | |
|---|---|---|---|---|
| 349,060 | | 9/1886 | Serve . | |
| 799,120 | | 9/1905 | Way . | |
| 1,947,606 | * | 2/1934 | Lonergan | 122/18.31 |
| 2,057,154 | * | 10/1936 | Lonergan | 122/18.31 |
| 2,151,540 | | 3/1939 | Varga . | |
| 2,550,965 | | 5/1951 | Brown, Jr. . | |
| 2,677,394 | * | 5/1954 | Brinen et al. | 138/38 |
| 2,688,986 | * | 9/1954 | O'Brien | 138/38 |
| 2,826,220 | * | 3/1958 | Young | 138/38 |
| 2,929,408 | * | 3/1960 | Weatherwax et al. | 138/38 |
| 3,171,389 | | 3/1965 | Throckmorton et al. . | |
| 3,397,440 | | 8/1968 | Dalin . | |
| 4,263,878 | | 4/1981 | Hurley et al. . | |
| 4,271,789 | | 6/1981 | Black . | |
| 4,286,655 | | 9/1981 | Trojani . | |
| 4,306,619 | | 12/1981 | Trojani . | |
| 4,352,378 | * | 10/1982 | Bergmann et al. | 138/38 |
| 4,380,215 | | 4/1983 | Mendelson . | |
| 4,466,567 | | 8/1984 | Garrison . | |
| 4,705,106 | | 11/1987 | Hornack et al. . | |
| 4,727,907 | * | 3/1988 | Duncan | 138/38 |
| 4,953,510 | | 9/1990 | Akkala et al. . | |
| 4,953,535 | | 9/1990 | Hagan . | |
| 5,372,188 | | 12/1994 | Dudley et al. . | |
| 5,411,013 | | 5/1995 | Kazen . | |
| 5,441,106 | | 8/1995 | Yukitake . | |
| 5,544,625 | | 8/1996 | Rivern . | |
| 5,575,273 | | 11/1996 | Moore, Jr. . | |
| 5,666,942 | | 9/1997 | Kazen . | |
| 5,704,417 | | 1/1998 | Christensen et al. . | |

FOREIGN PATENT DOCUMENTS

| | | |
|---|---|---|
| WO98/28578 | 7/1998 | (WO) . |

* cited by examiner

*Primary Examiner*—Jiping Lu
(74) *Attorney, Agent, or Firm*—Michael Best & Friedrich LLP

(57) ABSTRACT

A water heater includes a water tank, a combustion chamber below the tank and communicating with the flue tube, and a flue system. The flue system includes a flue tube, and a cruciform fin metallurgically bonded to the flue tube wall and dividing the flue tube into four flue chambers extending substantially parallel to the longitudinal axis of the flue tube. The flue system also includes a removable baffle hanging in each flue chamber. The baffles include adjustable turbulation surfaces to control the quality of combustion in the water heater.

45 Claims, 4 Drawing Sheets

WATER HEATER FLUE SYSTEM

FIELD OF THE INVENTION

The invention relates to flue systems for gas-fired water heaters.

BACKGROUND

It is known to weld or otherwise metallurgically bond fins inside a water heater flue tube to enhance heat conduction through the walls of the flue tube. It is also known to hang removable baffles in a flue tube to turbulate the exhaust gases flowing through the flue tube.

However, known systems often do not meet the current gas-fired water heater regulations relating to efficiency and construction for facilitating cleaning, and many of those water heaters that do meet the current regulations will not meet the next, more strict regulations to be enacted. For example, under today's regulations, the flue of a water heater has to be cleanable to remove soot and other buildup that may be hazardous. Many known flue systems were not designed to be easily cleaned, and therefore may not meet this regulation.

For example, one known flue tube fin arrangement includes a plurality of small fins extending radially inwardly into the flue tube from the flue tube wall. Soot can collect on these small fins, and the small fins are not easily cleaned with a brush. Another example is a twisted fin positioned within the flue tube. A twisted fin is not easily cleaned because a cleaning brush would have to be twisted to follow the contour of the fin.

SUMMARY

The present invention provides a flue system for a water heater. The flue system permits the combustion characteristics of the water heater to be tuned or adjusted. The system also permits relatively easy cleaning of the flue. The flue system includes a fin that is metallurgically bonded to the flue tube, and a removable baffle having at least one turbulation surface. The combustion quality of the water heater is adjusted by adding or removing baffles and by adjusting the turbulation surfaces of the baffles. The fin may be a cruciform-shaped fin, a pair of V-shaped fins, or a plurality of straight fins. Preferably, the fins divide the flue tube into flue chambers extending substantially parallel to the longitudinal axis of the flue tube, and the removable baffles are hung in selected flue chambers.

Other features and advantages of the invention will become apparent to those skilled in the art upon review of the following detailed description, claims, and drawings.

Figure 1:
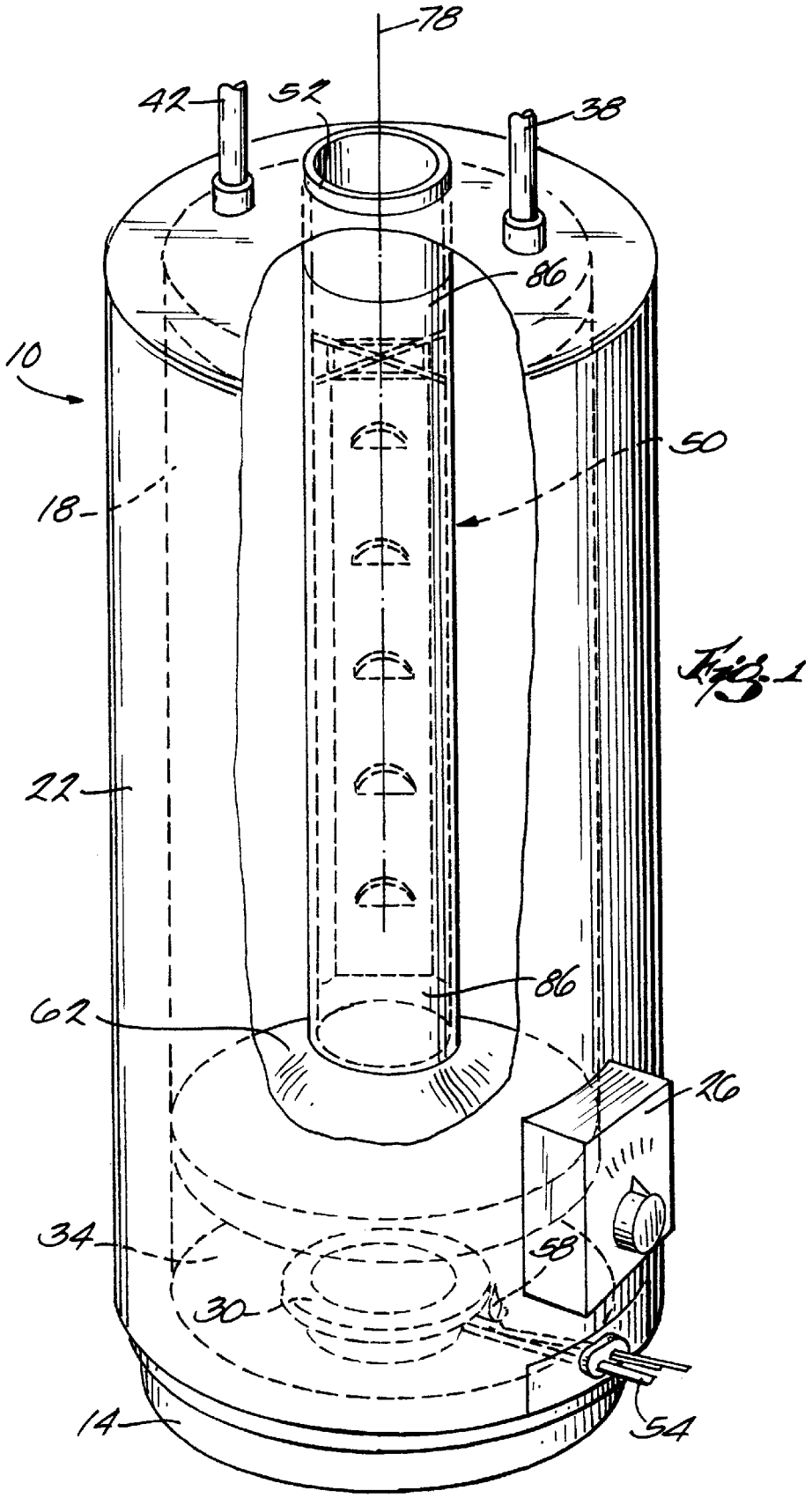
FIG. 1 is a perspective, partially cut-away view of a water heater embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a water heater 10 that includes a base pan 14, a tank 18 supported by the base pan 14 and containing water, an insulating jacket 22 surrounding the tank 18, a control system 26, a burner 30 disposed in a combustion chamber 34 beneath the tank 18, a water inlet pipe 38, a water outlet pipe 42, and a flue system 50 including a flue tube 52. In operation, gas fuel is provided to the burner 30 through a conduit 54. The gas is released by the burner 30 in a controlled fashion, and the gas is lit by a pilot light 58 that continually burns within the combustion chamber 34. Products of combustion from the burner 30 heat the water in the tank 18 through the tank bottom wall 62, which is dome-shaped. The products of combustion also flow up through the flue tube 52 and heat the water through the wall of the flue tube 52.

Figure 2:
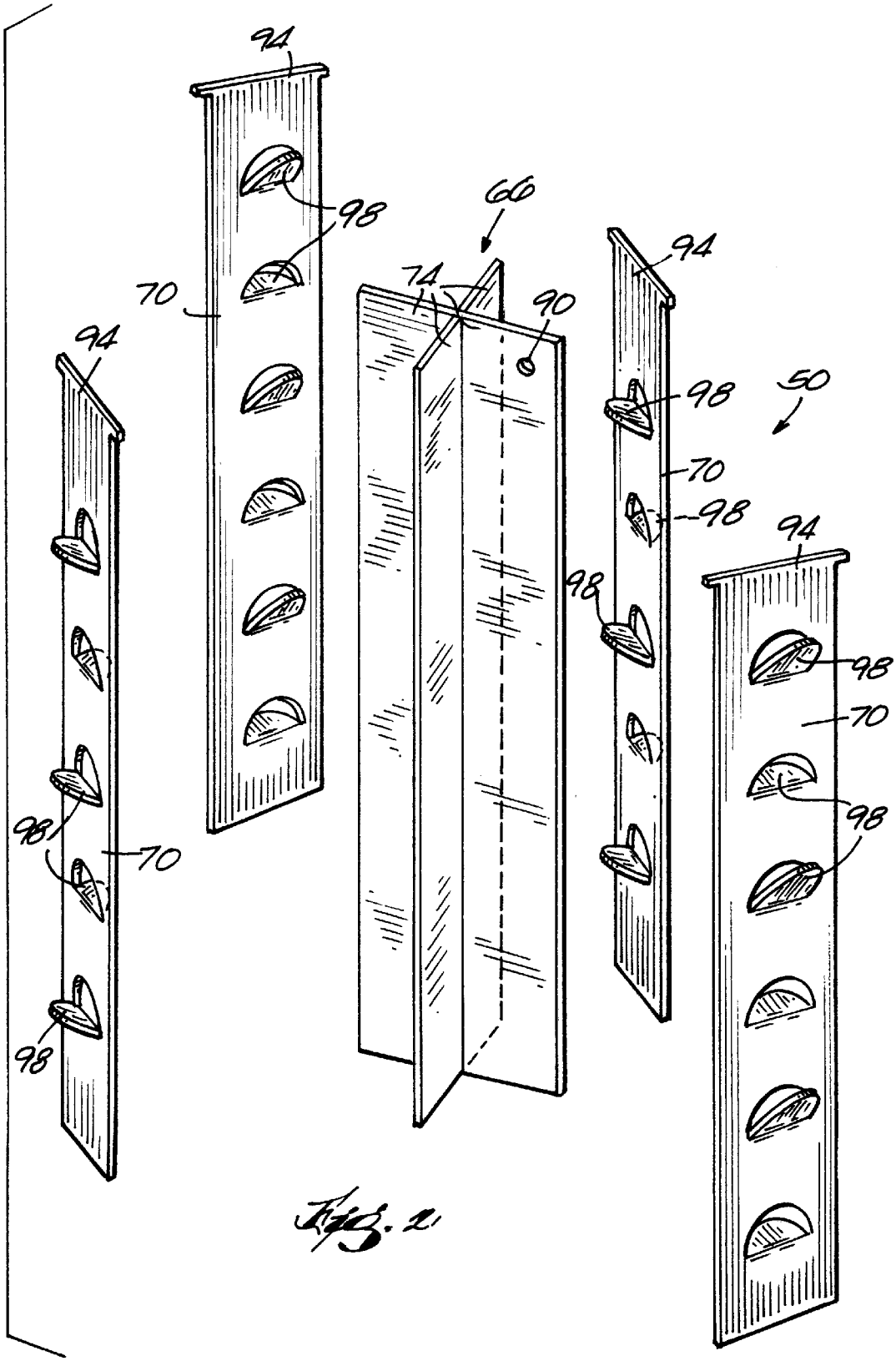
FIG. 2 is an enlarged exploded view of part of the flue system of FIG. 1.

FIG. 2 illustrates the flue system 50, which includes the flue tube 52 (FIG. 1), a fin structure 66, and four removable baffles 70. With additional reference to FIG. 3, the illustrated fin structure 66 is a cross-shaped or cruciform fin structure having four arms or fin portions 74 of substantially equal length joined along a central line that is substantially coincident with the longitudinal axis 78 of the flue tube 52.

Figure 3:
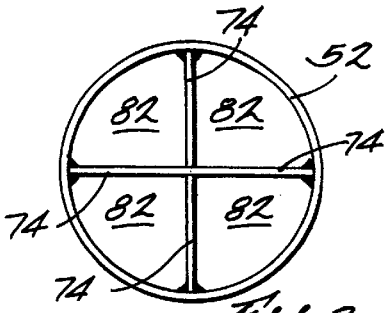
FIG. 3 is an end view of a flue tube including a first fin construction.

The outer edges of the fin portions 74 are metallurgically bonded to the inner surface of the flue tube wall as shown in FIG. 3. As used herein, "metallurgically bonded" means welded, brazed, or otherwise joined or fused together to facilitate heat conduction between two members. Preferably, the fin portions 74 are welded to the flue wall from the outside by penetration, laser, arc, or electron beam welding. Alternatively, the fin portions 74 may be welded from inside the tube 52 with a torch. A continuous weld along the entire length of the edge of the fin portions 74 is not necessary. Rather, the fin portions 74 may be welded along only a portion of each edge, either in a continuous weld or in several segmented welds. In this regard, the fin portions 74 may be welded along 100% or less of the length of the edges. Preferably, the fin portions 74 are welded between about 75% and 100% of the length of the edges to provide the desired heat transfer efficiency. Preferably, the flue system 50 is made of mild (i.e., low carbon) steel. In high efficiency models where corrosion caused by condensation is a concern, the flue system 50 may be constructed of an alloy such as stainless steel, Inconel, or an alloy of nickel. Alternatively, any suitable material may be used to construct the flue system 50.

The cruciform fin structure 66 provides several advantages. First, the cruciform fin structure 66 provides structural stability to the flue tube 52, which aids in the manufacture of the flue system 50. The structural stability permits the flue tube 52 to resist distortion during the glass-firing process and during insertion of the flue tube 52 into heads during assembly.

The cruciform fin structure 66 also substantially equally divides the inner volume of the flue tube 52 into four flue chambers 82 that extend substantially parallel to the longitudinal axis 78 of the flue tube 52. The four flue chambers 82 act as four flue tubes of relatively small cross-sectional area. The hottest gas within each flue chamber 82 is geometrically centered in the cross-sectional area of the flue chamber 82. If there were no fin structure 66 in the flue tube 52, the hottest gas would be centered with respect to the cross-sectional area of the flue tube 52. A second advantage of the cruciform fin structure 66, therefore, is that the hottest gas is closer to the flue wall than if the fin structure 66 were not present or if the fin structure 66 did not divide the flue tube into separate flue chambers 82.

A third advantage of the cruciform fin structure 66 is that it facilitates cleaning the flue tube 52. A cleaning brush may be easily inserted into the four flue chambers 82, and no twisting of the brush is required.

Another advantage lies in the fact that the four fin portions 74 of the fin structure 66 are connected at the center of the fin structure 66. In this regard, if one of the welds along one of the edges were to fail, the fin structure 66 would still be supported by the welds on the other fin portion 74 edges.

As shown in FIG. 1, the fin structure 66 is positioned within the flue tube 52 to leave a space 86 between the ends of the fin structure 66 and the ends of the tube 52. The space 86 facilitates mounting the flue tube 52 and fin structure 66 assembly on a glass coating machine that coats the inside and outside of the flue tube 52 and the fin structure 66 with a protective glass coating to resist degradation of the fin structure 66 and flue tube wall. Additionally, because the fin structure 66 is recessed with respect to the lower end of the flue tube 52, the fin structure 66 is less likely to be overheated by the extreme temperatures in the combustion chamber 34. The space 86 may be, for example, about three inches, but may be more or less depending on the circumstances.

To further facilitate the glass-coating process, one or more fin portions 74 may include a hole 90. The hole 90 may be engaged with a hook to suspend the fin structure 66 and flue tube 52 during the heating procedure of glass coating. This is an advantage over providing a hole in the flue tube 52. Holes in the flue tube 52 can interfere with welding the flue tube 52 to the head of the tank 18 if the hole is located too far from the end of the flue tube 52. On the other hand, if the hole is positioned too close to the end of the tube 52, the hook may tear through the flue tube wall at the elevated temperatures of the heating procedure. Additionally, a hole in the flue tube 52 would have to be patched or otherwise closed, while the hole in the fin portion 74 would not interfere with the operation of the water heater 10.

Because the fin portions 74 are metallurgically bonded to the flue wall, heat transfer between the fin portions 74 and the flue wall is improved over fin portions that are not metallurgically bonded to the flue wall. The metallurgical bonding therefore results in more efficient transfer of heat from the products of combustion to the water in the tank 18. The increased heat transfer of the cruciform fin structure 66 permits a water heater 10 to be made more compact than multiple flue designs. There is less welding, fewer components, lower cost, and less tooling involved in assembling a water heater 10 having the cruciform fin structure 66 when compared to a multiple flue design.

As seen in FIG. 2, the baffles 70 are elongated and include hangers 94 and turbulation surfaces 98. The baffles 70 may be constructed from, for example, strips of stainless steel having partially cut-out tabs that are bent to form the turbulation surfaces 98. Preferably, the tabs 98 are bent in alternating directions along the length of the baffle 70 as illustrated. The tabs 98 may be semicircular in a shape as illustrated or any other suitable shape. The turbulation surfaces 98 cause turbulent flow in the products of combustion moving through the flue tube 52. The turbulation surfaces 98 can be adjusted to provide more or less resistance to the flow of products of combustion. The turbulation surfaces 98 also resist downdrafts in the flue tube 52.

In this regard, the flue system 50 is adjustable, and the quality of combustion in the water heater 10 is able to be tuned to optimize combustion, residence time of the products of combustion within the flue tube 52, and heat transfer to the water in the tank 18. The baffles 70 may also be removed and replaced with baffles 70 having different arrangements of turbulation surfaces 98 to optimize these parameters and to accommodate different inputs to the burner 30.

Figure 7:
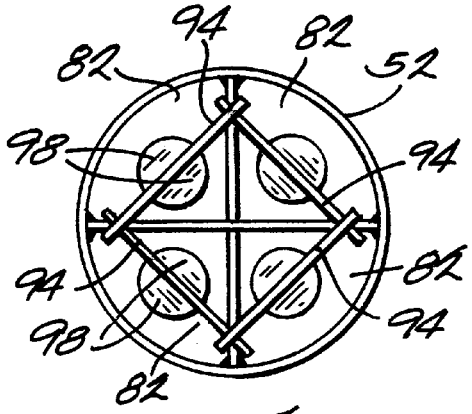
FIG. 7 is an end view of a flue tube including a first baffle orientation.
Figure 8:
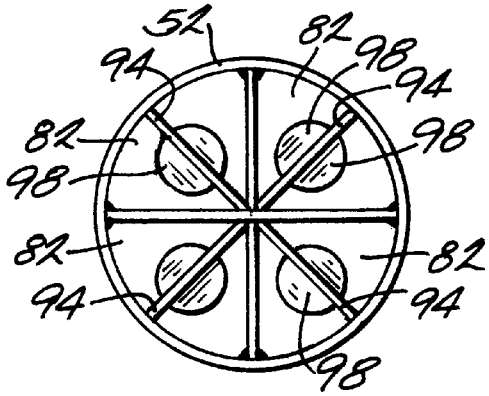
FIG. 8 is an end view of a flue tube including a second baffle orientation.

As can be seen in FIGS. 7 and 8, the baffles 70 may be supported with the hangers 94 in a square or chord pattern (FIG. 7), in a radial pattern (FIG. 8), or in a combination of the chord and radial patterns. Thus, the orientation in which the baffles 70 are hung may be used to further tune the combustion quality of the water heater 10. Also, one or more of the baffles 70 may be removed from the flue tube 52 to further customize the combustion quality.

Figure 9:
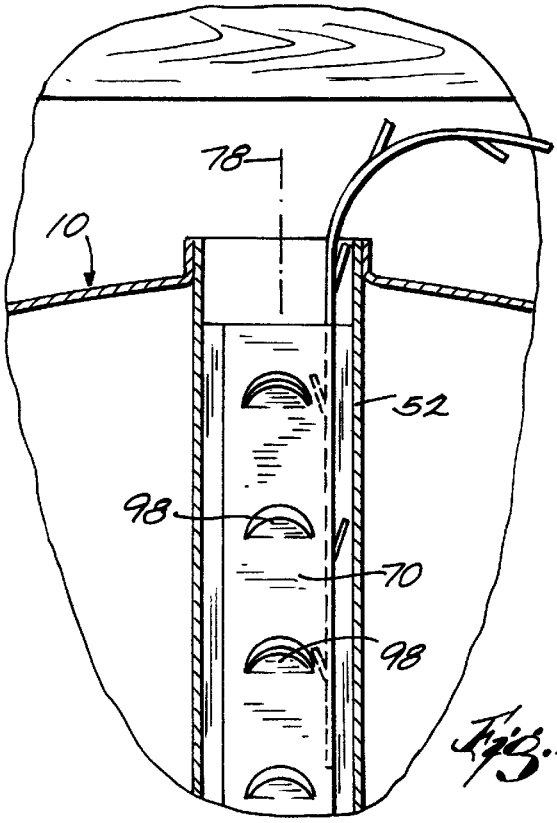
FIG. 9 is an enlarged view of the top portion of the water heater of FIG. 1, illustrating the removal of a baffle under low-clearance circumstances.

Referring now to FIG. 9, because the baffles 70 are made of relatively narrow strips of metal, they are more easily bent than traditional, larger baffles. As a result, the baffles 70 may be removed from a water heater 10 under low clearance conditions, where traditional, larger baffles could not be removed without first tipping or otherwise moving the water heater 10. The flue 52 and fin structure 66 are easily cleaned by removing the baffles 70 from the flue tube 52 and scrubbing the flue wall and fin structure 66 with a brush.

Figure 10:
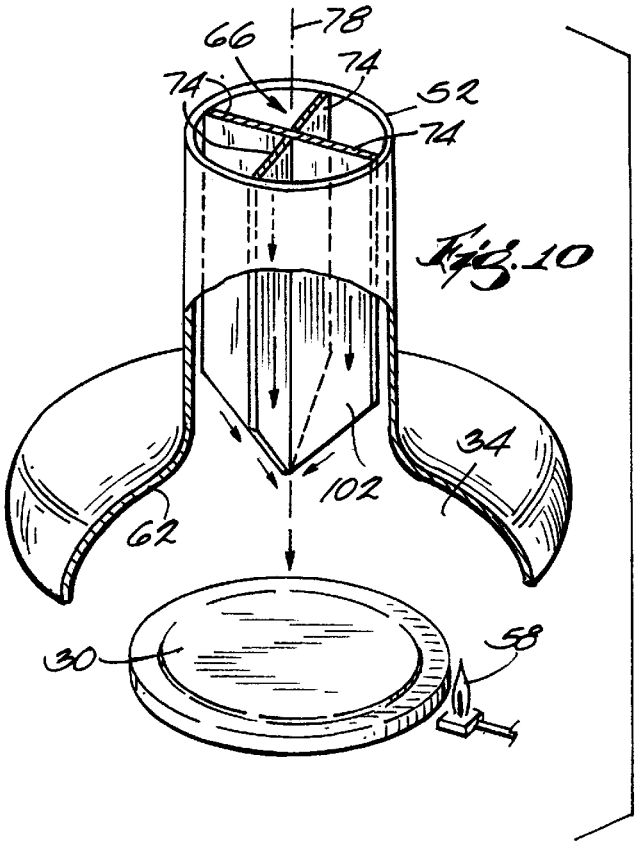
FIG. 10 is a perspective view of an alternative construction of the fin.

An alternative design for the lower end of the fin structure 66 is illustrated in FIG. 10. Here it is shown that the end 102 of the fin structure 66 may be shaped as a point (e.g., shaped as the end of a pointed stake). As condensation forms in the flue tube 52, water runs down the fin structure 66. In a flue system having a flat-bottom fin structure, some of the condensation may run along the domed bottom wall 62 of the tank 18 and drip onto the pilot light 58, potentially extinguishing the pilot light 58. With the pointed end 102 design shown in FIG. 10, substantially all of the condensation runs all the way down the fin structure 66 to the pointed end 102, and falls on the burner 30, where the condensation is evaporated. The pointed end 102 of the fin structure 66 may therefore help to keep the pilot light 58 from being inadvertently extinguished.

Figure 11:
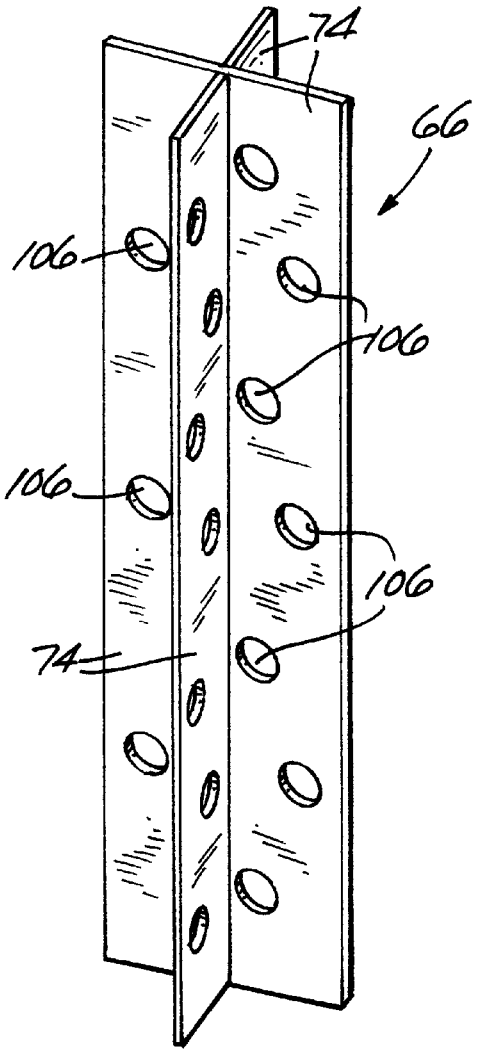

FIG. 11 illustrates another alternative construction of the fin structure 66. Here the fin structure 66 is provided with holes 106 to permit the cross-flow of the products of combustion through the fin structure 66. The holes 106 do not significantly interfere with cleaning the flue tube 52 and fin structure 66. The cross-flow holes 106 permit better mixing of the products of combustion.

Additionally, the holes 106 in the fin structure 66 illustrated in FIG. 11 may be provided by shear-forming tabs in a similar fashion to the tabs 98 of the baffle 70 described above. The tabs may be bent in alternating directions. In such a construction, the hanging baffles 70 would not be necessary, as the bent tabs formed in the fin structure 66 would serve as turbulation surfaces. The tabs would provide a greater and more efficient heat transfer surface than the fin structure 66 illustrated in FIG. 11.

Figure 4:
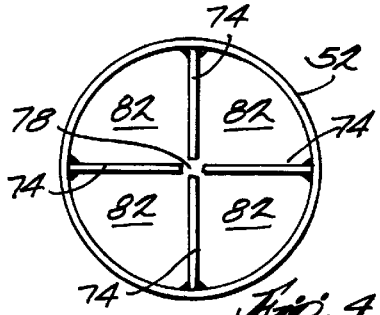
FIG. 4 is an end view of a flue tube including a second fin construction.
Figure 5:
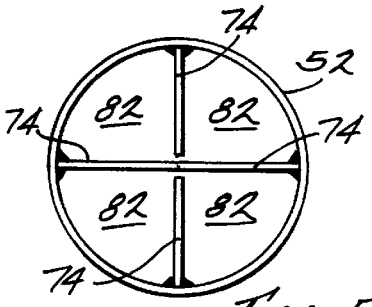
FIG. 5 is an end view of a flue tube including a third fin construction.
Figure 6:
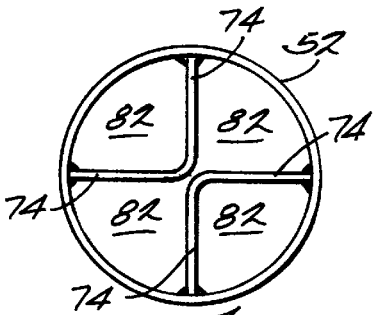
FIG. 6 is an end view of a flue tube including a fourth fin construction.

Alternative fin structure 66 configurations are illustrated in FIGS. 4–6. Each alternative fin structure 66 configuration includes a plurality of fin portions 74. In each configuration, however, the fin portions 74 substantially divide the flue tube 52 into four flue chambers 82. In each configuration, the fin portions 74 may be sized so that they abut each other near the center of the flue tube 52, or the fin portions 74 may be intentionally sized to not quite touch each other. If the fin portions 74 do not touch each other, the space between the inner edges of the fin portions 74 acts as a buffer, absorbing any distortion of the flue tube 52, and permitting the flue tube 52 to be radially compressed before the fin portions 74 touch each other and provide support for the flue wall.

In FIG. 4, the outer edge of each of four fin portions 74 is metallurgically bonded to the flue wall. The inner edge of each fin portion 74 is positioned near the longitudinal axis 78 of the flue tube 52.

In FIG. 5, three fin portions 74 are provided, one of which is metallurgically bonded to the flue wall along both edges, and two that each have one edge metallurgically bonded to the flue wall. The two fin portions 74 that have free ends may or may not touch the fin portion 74 that is metallurgically bonded at both ends.

FIG. 6 illustrates a configuration with two fin portions 74, in which the fin portions 74 are V-shaped. Both edges of the V-shaped fins portions 74 are metallurgically bonded to the flue wall. The bases of the V-shaped fin portions 74 are positioned near each other substantially along the longitudinal axis 78 of the flue tube 52. Preferably, the bases of the V-shaped fin portions 74 are approximately 0.030 inches from each other. Also, each leg of the V-shaped fin portions 74 is preferably welded to the inner surface of the flue tube 52 on both sides of the leg.

Although all of the fin structure 66 configurations illustrated herein substantially divide the flue tube 52 into four flue chambers 82, other fin structure configurations are contemplated. For example, a fin structure configuration could be provided in which the flue tube is divided into less than or more than four flue chambers 82.

What is claimed is:

1. A water heater comprising:

a tank for holding water;

a combustion chamber;

a flue tube having a longitudinal axis and extending through said tank along said longitudinal axis and communicating with said combustion chamber, said flue tube having an inner surface;

a first fin positioned within said flue tube, said fin having first and second edges that are both at least partially metallurgically bonded to said inner surface to divide said flue tube into first and second flue chambers extending substantially parallel to said longitudinal axis; and first and second removable baffles positioned within said first and second flue chambers, respectively, said first and second baffles each having at least one turbulation surface.

2. The water heater of claim 1, wherein said fin is metallurgically bonded to said inner surface along about 75% of said first edge.

3. The water heater of claim 1, further comprising second and third fins metallurgically bonded to said first fin to define a cruciform structure having four arms, and wherein each of said four arms is at least partially metallurgically bonded to said inner surface.

4. The water heater of claim 1, wherein said first and second baffles are both constructed from an elongated metal strip positioned substantially parallel to said longitudinal axis, and wherein said turbulation surface of each baffle is a tab partially cut out of said strip and bent at an angle with respect to said strip.

5. The water heater of claim 4, wherein said tab is substantially semicircular in shape.

6. The water heater of claim 4, wherein each of said baffles includes a plurality of turbulation surfaces, said turbulation surfaces being bendable with respect to said elongated strip to tune the combustion quality of said water heater.

7. The water heater of claim 1, wherein each of said baffles includes a plurality of turbulation surfaces, said turbulation surfaces being bent in alternating opposite directions along the length of said baffles.

8. The water heater of claim 1, wherein each of said baffles is elongated and flexible to facilitate removal of said baffles in circumstances where said baffles cannot be removed in a straight condition without moving said tank.

9. The water heater of claim 1, wherein said flue tube includes top and bottom ends, said first fin being spaced from each of said top and bottom ends.

10. The water heater of claim 1, wherein said fin is metallurgically bonded to said inner surface by welding.

11. The water heater of claim 1, wherein said fin is substantially planar in shape and extends straight across a portion of said flue tube.

12. The water heater of claim 1, wherein said flue chambers are substantially the same size.

13. The water heater of claim 1, further comprising fin structure positioned within/said flue tube and at least partially defining a third flue chamber within said flue tube.

14. The water heater of claim 13, further comprising a third removable baffle positioned within said third flue chamber.

15. The water heater of claim 13, wherein said fin structure at least partially defines a fourth flue chamber within said flue tube.

16. The water heater of claim 15, further comprising third and fourth removable baffles positioned within said third and fourth flue chambers, respectively.

17. The water heater of claim 15, wherein said fin structure is separate from said first fin.

18. The water heater of claim 13, wherein said fin structure is separate from said first fin.

19. The water heater of claim 1, wherein said first fin is substantially V-shaped, said water heater further comprising a second substantially V-shaped fin, wherein each of said first and second V-shaped fins has first and second free edges at least partially metallurgically bonded to said inner surface, said first and second fins dividing said flue tube into four flue chambers extending substantially parallel to said longitudinal axis.

20. The water heater of claim 19, wherein said first and second V-shaped fins contact each other substantially along said longitudinal axis.

21. The water heater of claim 19, wherein said first and second V-shaped fins are at least partially metallurgically bonded to each other.

22. The water heater of claim 1, further comprising a second fin metallurgically bonded to said inner surface, whereby said first and second fins substantially divide said flue tube into a plurality of flue chambers extending substantially parallel to said longitudinal axis.

23. The water heater of claim 1, further comprising second and third fins, wherein each of said second and third fins includes a first edge metallurgically bonded to said inner surface and a second edge disposed substantially along said longitudinal axis.

24. The water heater of claim 1, wherein said fin has a pointed lower end near said combustion chamber, said lower end directing condensation toward the middle of said combustion chamber.

25. The water heater of claim 1, wherein said fin is perforated to permit the flow of fluids transverse to said longitudinal axis through said fin.

26. A water heater comprising:

a tank for holding water;

a combustion chamber;

a flue tube extending through said tank and communicating with said combustion chamber, said flue tube having an inner surface and a longitudinal axis;

a fin structure positioned within said flue tube, said fin structure including four fin portions metallurgically bonded to said inner surface to substantially divide said flue tube into four flue chambers extending substantially parallel to said longitudinal axis; and first, second, third, and fourth baffles, each of said baffles including at least one turbulation surface, and each of said baffles being removably positioned within a respective one of said four flue chambers.

27. The water heater of claim 26, wherein each of said fin portions includes an edge, and wherein each of said fin portions is metallurgically bonded to said inner surface along about 75% of said edge.

28. The water heater of claim 26, wherein said turbulation surface of said first baffle is adjustable to modify the flow of products of combustion through said flue tube.

29. The water heater of claim 26, wherein said flue tube includes a length and opposite ends, and wherein said fin portions extend along at least half of the length of said flue tube and are spaced from said ends of said flue tube.

30. The water heater of claim 26, wherein at least one of said baffles is elongated and flexible to facilitate removal of said baffle in circumstances where said baffle cannot be removed in a straight condition without moving said tank.

31. The water heater of claim 26, wherein at least one of said fin portions is metallurgically bonded to said inner surface by welding.

32. The water heater of claim 26, wherein at least one of said baffles is constructed from an elongated metal strip positioned substantially parallel to said longitudinal axis, and wherein said turbulation surface of said baffle is a tab partially cut out of said strip and bent at an angle with respect to said strip.

33. The water heater of claim 32, wherein said tab is substantially semicircular in shape.

34. The water heater of claim 26, wherein at least one of said baffles includes a plurality of turbulation surfaces, said turbulation surfaces being bent in alternating opposite directions along the length of said baffle.

35. The water heater of claim 26, wherein at least one of said baffles includes a hanger portion, said baffle being supported within said flue tube by said hanger portion with said hanger portion being arranged as a chord of the flue tube cross-section.

36. The water heater of claim 26, wherein none of said four fin portions are interconnected with any other of said four fin portions.

37. The water heater of claim 26, wherein each of said four fin portions is interconnected with the other three fin portions.

38. The water heater of claim 37, wherein said four fin portions are all integrally formed with each other.

39. The water heater of claim 26, wherein one pair of said four fin portions is interconnected with each other.

40. The water heater of claim 39, the other pair of said four fin portions is interconnected with each other.

41. The water heater of claim 26, wherein said fin structure has a pointed lower end near said combustion chamber, said lower end directing condensation toward the middle of said combustion chamber.

42. The water heater of claim 26, wherein at least one of said fin portions is perforated to permit the flow of fluids transverse to said longitudinal axis through said fin structure.

43. The water heater of claim 26, wherein at least one of said baffles includes a hanger portion, said baffle being supported within said flue tube by said hanger portion with said hanger portion being arranged radially with respect to said flue tube.

44. A water heater comprising:

a tank for holding water;

a combustion chamber;

a flue tube extending through said tank and communicating with said combustion chamber, said flue tube having an inner surface and a longitudinal axis;

a fin structure positioned within said flue tube, said fin structure including a pair of V-shaped fin portions at least one of said V-shaped fins having first and second edges at least partially metallurgically bonded to said inner surface to substantially divide said flue tube into a plurality of flue chambers extending substantially parallel to said longitudinal axis; and first and second removable baffles each positioned within one of said flue chambers and each including at least one turbulation surface.

45. The water heater of claim 44, wherein said V-shaped fin portions are metallurgically bonded to each other substantially along said longitudinal axis.

* * * * *